United States Patent [19]

Polinski

[11] 4,410,143

[45] Oct. 18, 1983

[54] MAIN SHAFT ASSEMBLY FOR A GYRATORY CRUSHER

[75] Inventor: Donald J. Polinski, Combined Locks, Wis.

[73] Assignee: Allis-Chalmers Corporation, Milwaukee, Wis.

[21] Appl. No.: 190,918

[22] Filed: Sep. 26, 1980

[51] Int. Cl.[3] ..... B02C 2/06

[52] U.S. Cl. ..... 241/209; 241/215; 241/286

[58] Field of Search ..... 241/286, 290, 207–216

[56] References Cited

U.S. PATENT DOCUMENTS

| | | | |
|---|---|---|---|
| 2,832,547 | 4/1958 | Kennedy | 241/209 |
| 2,941,732 | 6/1960 | Cross et al. | 241/286 X |
| 3,750,967 | 8/1973 | DeDiemar et al. | 241/207 |
| 3,834,633 | 9/1974 | Dougall et al. | 241/207 |

*Primary Examiner*—Mark Rosenbaum
*Assistant Examiner*—Timothy V. Eley
*Attorney, Agent, or Firm*—Thomas G. Anderson

[57] ABSTRACT

In a gyratory crusher, a main shaft having a tapered mantle supporting portion extending through a correspondingly tapered bore in the crusher mantle to support the mantle on the shaft, and a bearing sleeve fitted about the end of the shaft releasably securing the crusher mantle to the tapered portion of the shaft.

11 Claims, 10 Drawing Figures

MAIN SHAFT ASSEMBLY FOR A GYRATORY CRUSHER

FIELD OF THE INVENTION

The present invention relates to gyratory crushers and, in particular, to the main shaft supporting the crusher head or mantle within the crusher.

DESCRIPTION OF THE PRIOR ART

As exemplified by U.S. Pat. Nos. 2,883,218 and 4,034,922, a gyratory crusher typically includes a main shaft provided with a tapered portion which supports the crusher head or mantle through a correspondingly tapered internal bore extending through the mantle. To secure the mantle to the shaft, a threaded section has generally been provided on the shaft immediately above the tapered portion supporting the mantle for receiving a head nut which forces the mantle against the tapered portion of the shaft. While this type of arrangement has proven to be satisfactory for most crusher installations, experience has indicated that the relatively abrupt changes in the cross-sectional area of the shaft above and below the threaded section have resulted in high local stress concentrations in these regions of the shaft. These stress concentrations are in addition to the substantial stresses generated by the cyclic bending loads applied to the shaft by the mantle during operation of the crusher. The result has been the development of fatigue cracks or fractures in the threaded section of the shaft as well as immediately above and below it where the highest stresses occur due to the abrupt changes in the cross-sectional area of the shaft. Over a period of time the cracks continue to grow and ultimately render the shaft unserviceable requiring that the crusher be taken out of service and the shaft replaced before crushing operations can be resumed. Similarly, if the manganese steel mantle works loose on the shaft due to localized work hardening which causes it to expand about the axis of the shaft, the rocking motion of the mantle can shear off the threads securing it to the shaft.

SUMMARY OF THE INVENTION

The present invention relates to gyratory crushers and, in particular, to a main shaft and bearing sleeve arrangement supporting the crusher head or mantle wihin the crusher.

The main shaft includes a tapered head supporting portion which extends through a correspondingly tapered bore in a conically shaped crusher mantle to support the mantle on the shaft. The end of the shaft is provided with a bearing journal fitted with a replaceable sleeve arrangement retained in a stationary bushing on the frame of the crusher which accommodates gyratory movement of the shaft about the bushing during crushing operations. The sleeve arrangement, which is releasably secured to the bearing journal at the low stressed, outermost end of the shaft, includes a head nut which abuts the mantle to secure it to the tapered portion of the shaft.

From the foregoing, it can be seen that the invention contemplates an arrangement wherein abrupt structural discontinuities in the normally high-stressed regions of the main shaft have been essentially eliminated to minimize the development of fatigue fractures in the shaft while at the same time providing an arrangement which can be easily maintained and repaired in the field, it being understood that various changes can be made in the arrangement, form and construction of the apparatus disclosed herein without departing from the spirit and scope of the invention.

DESCRIPTION OF THE PREFERRED EMBODIMENT

Figure 1:
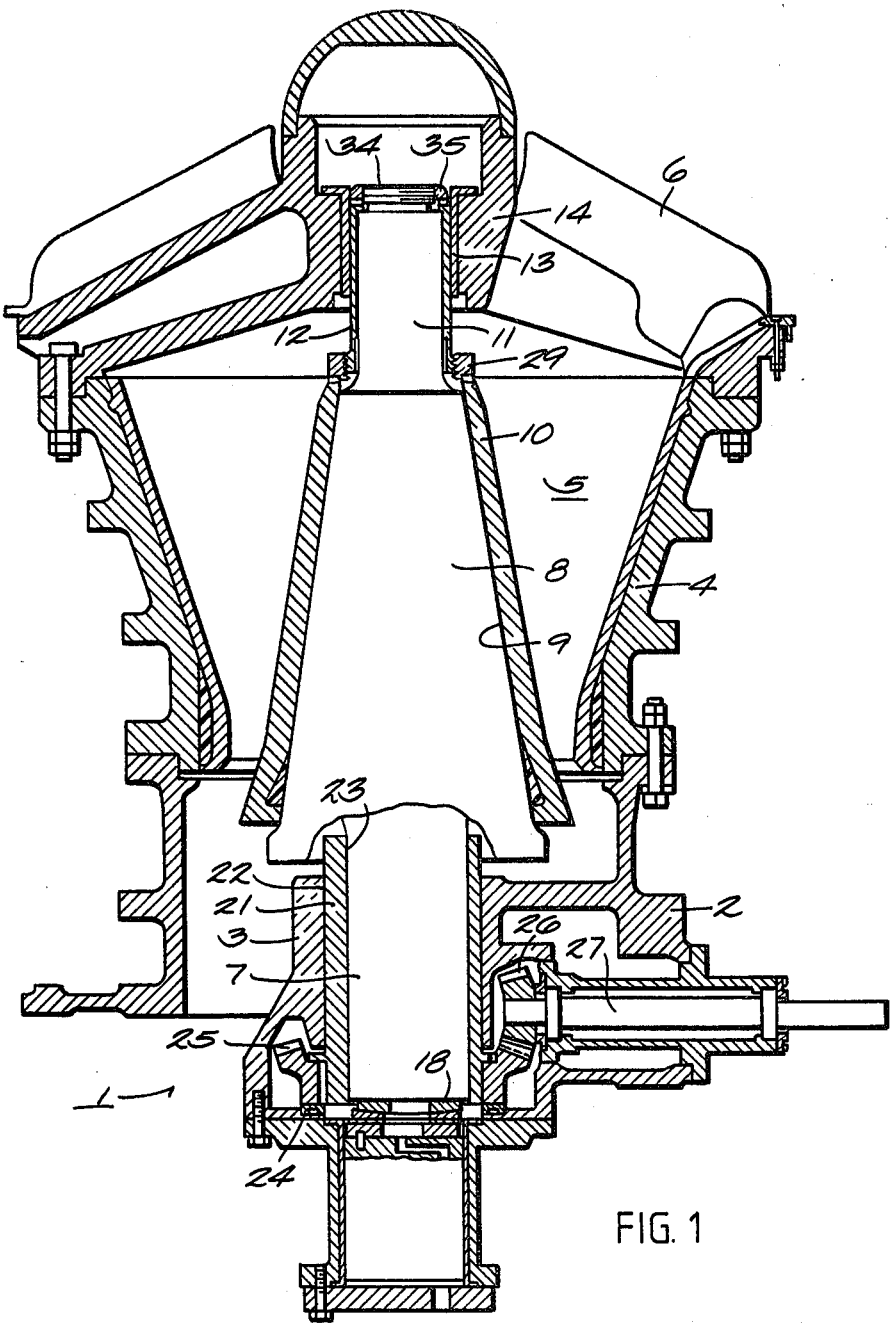
FIG. 1 is a vertical cross-sectional view through a gyratory crusher equipped with the crusher shaft and sleeve arrangement embodying the invention.

Referring to FIG. 1, the gyratory crusher 1 embodying the invention includes a lower frame 2 provided with a vertical hub 3, an upper frame 4 forming the outer shell of the crusher chamber 5, a top frame or spider 6 mounted on the upper frame 4, and a centrally located gyratable main shaft 7. The main shaft 7 includes a tapered or frustoconically shaped mantle supporting portion 8 which extends through a correspondingly tapered bore 9 in a conically shaped crusher mantle 10 to support the mantle on the shaft 7. As will be described, the cross-section of the upper end of the shaft 7 gradually converges to form a bearing journal 11 extending from the tapered portion of the shaft which is fitted with a cylindrical bearing sleeve 12 rotatably retained within a bearing bushing 13 secured within a coaxially aligned hub 14 in the spider 6.

The main shaft 7, which is carried on an axial thrust bearing 18 mounted on the lower frame 2 beneath the shaft, is rotatably journaled within an eccentric sleeve bearing carried within the vertical hub 3 to direct the gyratory movement of the shaft. As shown in FIG. 1, the sleeve bearing includes an eccentric 21 having an outer cylindrical surface 22 journaled within the hub 3 and an eccentrically disposed internal bore 23 which receives the shaft 7 along an axis inclined to the external surface of the sleeve. The eccentric is carried by a supporting bearing 24 on the lower frame 2 and includes a ring gear 25 secured about its periphery which is driven by a driving pinion 26 mounted on a horizontally extending drive shaft 27 journaled within the lower frame 2. The drive shaft 27 is connected with a suitable rotary drive (not shown) which in turn rotates the eccentric 21 through the ring gear 25 and pinion 26 to effect gyratory movement of the main shaft about the bushing 13 during crushing operations.

Figure 2:
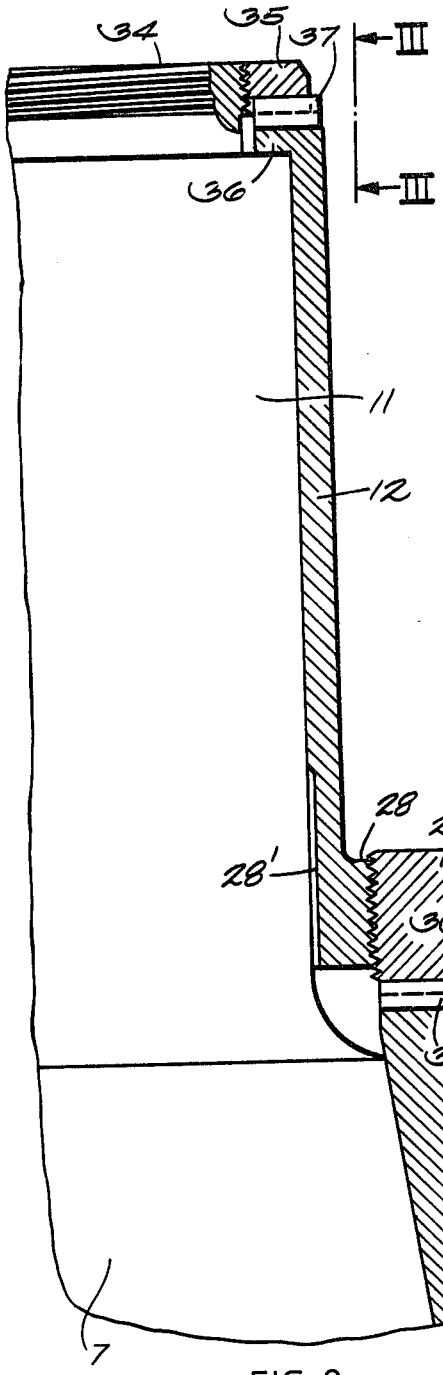
FIG. 2 is an enlarged partial cross-sectional view of the crusher main shaft and sleeve arrangement as it is shown in FIG. 1.

As shown in FIGS. 1 and 2, the bearing sleeve 12 extends generally coextensively with the bearing journal 11 and includes an externally threaded annular shoulder 28 about its lower periphery threadably receiving a head nut 29. The head nut 29 abuts the upper edge 30 of the mantle 10 to secure it to the tapered portion of the main shaft 7, and at least one rod or dowel 31 is welded in a corresponding pair of semi-circular keyways in the head nut and the mantle to prevent rotation between these members after the head nut is secured in position. Additionally, to abate fretting corrosion of the main shaft in the normally high stressed portion of the shaft at the base of the bearing journal 11, the sleeve is counterbored as indicated at 28' to prevent engagement between the sleeve and the main shaft in the proximity of the threaded annular shoulder 28.

Figure 3:
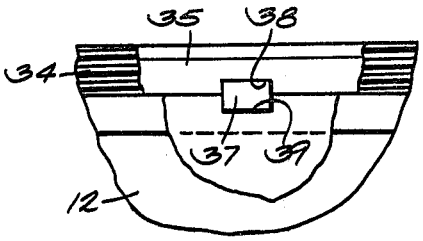
FIG. 3 is a fragmentary elevational view taken substantially along line III—III in FIG. 2.
Figure 4:
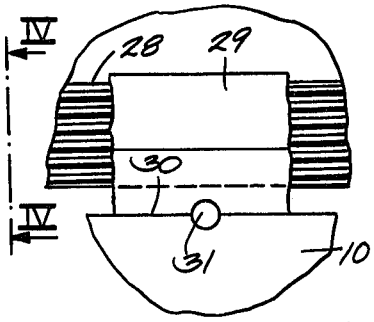
FIG. 4 is a fragmentary elevational view taken substantially along line IV—IV in FIG. 2.

When the bearing sleeve 12 is installed on the bearing journal 11, it is initially heated so that as it cools it forms a heat-shrink type fit releasably securing it to the journal. While this heat-shrink type connection will generally be sufficient to secure the sleeve and thus the crusher mantle on the shaft during normal crusher operations, the invention also specifically provides for securing the sleeve to the journal 11 in the low stressed, uppermost region of the shaft. As best shown in FIGS. 2 and 3, a threaded lug 34 is provided on the end of the journal which is adapted to receive a sleeve nut 35 which axially overlies an inwardly projecting annular lip 36 on the upper end of the sleeve 12. The annular lip 36 is secured against the upper marginal edge surface of the shaft 7 by the sleeve nut 35 which is in turn rigidly coupled to the sleeve 12 by at least one key 37 welded in a corresponding pair of keyways 38 and 39 spaced about the peripheries of the sleeve nut and the sleeve. It should be noted that the direction of the threading on the lug 34 and the sleeve nut 35 is such that the sleeve nut is essentially self-tightening. More particularly, in the present arrangement the eccentric is driven in a clockwise direction so that the materials moving through the crusher tend to rotate the mantle in a counterclockwise direction. Thus, the self-tightening head nut 29 has a tendency to rotate in a clockwise direction on the threaded annular shoulder 28. Should the threads 28 become damaged and locked, a torsional force would be transmitted through the sleeve to the sleeve nut via the key 37 so as to constantly urge the sleeve nut into engagement with the annular lip of the sleeve, thereby preventing excessive rotation of the sleeve on the main shaft.

Figure 5:
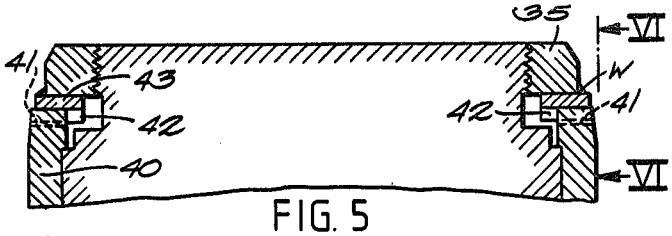
FIG. 5 is a partial cross-sectional view similar to FIG. 2 showing an alternative embodiment of the invention.
Figure 6:
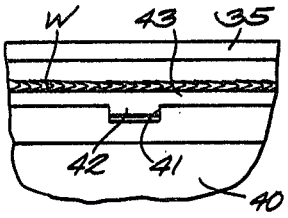
FIG. 6 is a fragmentary elevational view taken substantially along line VI—VI in FIG. 5.

FIGS. 5 and 6 show a second embodiment of the invention wherein like numerals designate the elements which are substantially the same as those of the first embodiment shown in FIGS. 1–4. In this embodiment, a cylindrical bearing sleeve 40 is provided with a pair of upwardly opening radial slots 41 which are adapted to receive a corresponding pair of axially projecting teeth 42 on a washer 43 interposed between the sleeve nut 35 and the sleeve 40. In this arrangement, the washer 43 is welded as indicated at "w" to the self-tightening sleeve nut 35 after it is secured in the sleeve retaining position shown in the drawings to provide the torsional rigidity effected by the keys 37 in the first embodiment.

Figure 7:
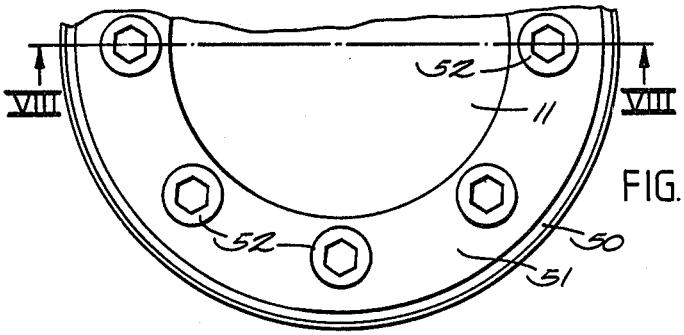
FIG. 7 is a top view of the crusher shaft showing another embodiment of the invention.
Figure 8:
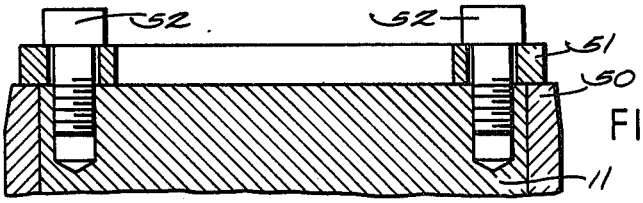
FIG. 8 is a partial cross-sectional view taken substantially along line VII—VII in FIG. 7.

FIGS. 7 and 8 show another embodiment of the invention wherein a cylindrical bearing sleeve 50 is retained on the bearing journal 11 by a retaining ring 51 sized to axially overlie the outermost ends of the journal 11 and the sleeve 50. As shown in the drawings, a plurality of cap screws 52 or the like are spaced about the ring 51 to secure it to the bearing journal 11.

Figure 9:
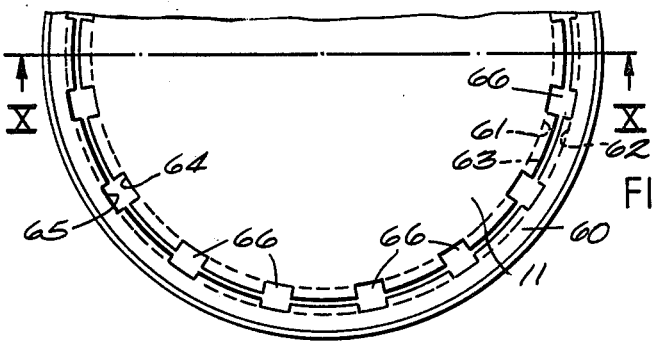
FIG. 9 is a top view of the crusher shaft showing yet another embodiment of the invention.
Figure 10:
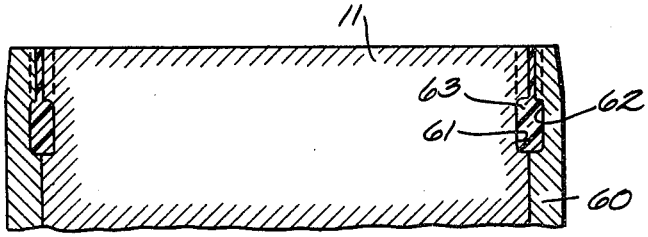
FIG. 10 is a partial cross-sectional view taken substantially along line X—X in FIG. 9.

FIGS. 9 and 10 show yet another embodiment of the invention wherein a cylindrical bearing sleeve 60 is secured to the bearing journal 11 by an adhesive epoxy backing compound which hardens to form a rigid slot and key arrangement adapted to restrain axial and rotational movement between the sleeve and the journal. As shown in the drawings, the journal 11 is provided with an exterior peripheral groove 61 about which an interior groove 62 in the sleeve 60 is aligned to form an annular chamber 63 between the journal 11 and the sleeve 60, and similarly, a plurality of radially extending slots 64 and 65 spaced about the respective peripheries of the bearing journal and the sleeve are aligned to provide a plurality of radially extending cavities 66. Considering the foregoing, it can be seen that when a hardenable adhesive such as an epoxy backing compound is injected into the cavities 66 and the annular chamber 63, a rigid adhesive bond is formed between the sleeve and the journal as the epoxy hardens which also provides a rigid key-like member restraining relative movement between the sleeve and the journal.

In view of the above, it can be seen that the main shaft in each of the foregoing embodiments is essentially free of abrupt cross-sectional discontinuities in the normally high-stressed region of the shaft proximate the crusher mantle. As a result, the susceptibility of the shaft to the cracking and fatigue fracture experienced with the main shaft designs discussed above in regard to the prior art has been substantially reduced. Moreover, in the event the crusher head works loose on the shaft due to localized work hardening or the like, generally only the threading on the relatively inexpensive and easily replaced bearing sleeve will be damaged. Thus, the crusher can be promptly put back in service by simply replacing the bearing sleeve.

The embodiments of the invention in which an exclusive property or privilege is claimed are defined as follows:

1. In a gyratory crusher including a lower frame, an upper frame mounted on the lower frame, a crusher mantle having a tapered internal bore extending through the mantle, and a shaft having a correspondingly tapered mantle supporting portion projecting through the bore in generally contiguous supportive engagement with the mantle to support the mantle on the shaft, the improvement comprising:

a bearing journal projecting from said supporting portion to form the end of the shaft;

a bearing sleeve releasably secured about said journal including shoulder means engaging the crusher mantle to restrain axial displacement of the mantle along the shaft;

stationary first bearing means retained by the upper frame retaining said bearing sleeve and journal and second bearing means retained by the lower frame supporting the shaft for gyratory movement about the axis of said first bearing means during operation of the crusher; and sleeve fastening means releasably securing the bearing sleeve to the shaft at the outermost end of the journal remote from bending loads imposed on the shaft by the mantle during operation of the crusher.

2. The improvement according to claim 1, and said shoulder means including a threaded annular section on the sleeve, and a head nut threadably secured to said section in abutting relation to the crusher mantle.

3. The improvement according to claim 2, and the interior of said sleeve being counterbored to prevent engagement between the sleeve and the shaft in the proximity of said threaded annular section.

4. The improvement according to claim 1, and said sleeve being releasably secured to the journal in heat shrink-fit relation.

5. The improvement according to claim 1, and said sleeve fastening means including a threaded lug projecting from the outermost end of the journal and a sleeve nut sized to axially overlie the sleeve threadedly secured to the lug.

6. The improvement according to claim 5, and second key means coupling the sleeve nut and the sleeve to prevent relative rotational movement therebetween.

7. The improvement according to claim 1, and said sleeve fastening means including an annular retaining ring sized to axially overlie the outermost ends of the journal and the sleeve, and mechanical fastening means releasably securing said ring to the shaft.

8. The improvement according to claim 1, and said sleeve including an inwardly projecting annular lip sized to overlie the marginal edge of the outermost end of the journal; and mechanical fastening means releasably securing said lip to the journal.

9. The improvement according to claim 1, and said fastening means including a plurality of axially extending exterior slots in said journal spaced about its periphery and said sleeve having a corresponding plurality of interior slots in registry with said exterior slots forming a plurality of radially extending cavities between the journal and the sleeve; and a relatively rigid adhesive material filling said cavities obstructing relative rotational movement between the journal and the sleeve.

10. The improvement according to claim 1, and said fastening means including an exterior groove about the periphery of said journal and said sleeve having a corresponding interior groove in registry with said exterior groove to form an annular chamber between the journal and the sleeve; and a relatively rigid adhesive material filling said annular chamber obstructing relative axial movement between the journal and the sleeve.

11. The improvement according to claim 10, and said journal having a plurality of axially extending exterior slots spaced about its periphery and said sleeve having a corresponding plurality of interior slots in registry with said exterior slots to form a plurality of radially extending cavities opening into said annular chamber; and said rigid adhesive material filling said cavities and said chamber to form an adhesive bond between the journal and the sleeve and obstruct relative movement therebetween.

* * * * *